United States Patent [19]

Tanaka

[11] Patent Number: 4,733,465

[45] Date of Patent: Mar. 29, 1988

[54] PROCESS FOR MANUFACTURING ELECTRICAL CONTACT PIN

[75] Inventor: Yoshihito Tanaka, Tokyo, Japan

[73] Assignee: Hirose Electric Co., Ltd., Tokyo, Japan

[21] Appl. No.: 22,783

[22] Filed: Mar. 6, 1987

Related U.S. Application Data

[62] Division of Ser. No. 865,458, May 21, 1986.

[30] Foreign Application Priority Data

Jul. 2, 1985 [JP] Japan ..... 60-144946

[51] Int. Cl.[4] ..... H01R 43/16

[52] U.S. Cl. ..... 29/874; 439/82; 439/751

[58] Field of Search ..... 29/874, 845; 72/411, 72/416, 474, 475; 439/84, 78, 82, 83, 84, 733, 751

[56] References Cited

U.S. PATENT DOCUMENTS

| | | | |
|---|---|---|---|
| Re. 32,212 | 7/1986 | Walter et al. | 439/82 |
| 3,827,004 | 7/1974 | Heuvel et al. | 439/82 |
| 4,415,220 | 11/1983 | Kant | 439/751 |
| 4,475,780 | 10/1984 | Walter et al. | 439/82 |
| 4,557,539 | 12/1985 | Zust et al. | 29/845 |
| 4,585,293 | 4/1986 | Czeschka et al. | 439/82 X |
| 4,586,778 | 5/1986 | Walter et al. | 439/82 X |

*Primary Examiner*—Howard N. Goldberg
*Assistant Examiner*—Carl J. Arbes
*Attorney, Agent, or Firm*—Yusuke Takeuchi

[57] ABSTRACT

An electrical contact pin has a fixing part to be fitted into a through hole of a circuit board for fixing without using any solder. The fixing part has a substantially rectangular cross section. A pair of alternating recesses are provided on opposite sides of said rectangular section. A pair of corners closer to said recesses extend beyond said sides to form a pair of projected corners. A process for manufacturing such an electrical contact pin is characterized by the step of pressing a metal work having a substantially rectangular cross section to form said fixing part in a pair of metal dies. A pair of projections are provided on the bottoms of said dies to form said recesses. A pair of opposite sides of said dies are arranged so that there may be small spaces between said pair of sides and the opposite sides of said work before pressed. A part of said bottom of each die is made deeper than the rest of said bottom so as to form said projected corner when said work is squeezed.

2 Claims, 14 Drawing Figures

PROCESS FOR MANUFACTURING ELECTRICAL CONTACT PIN

This is a division of Ser. No. 865,458 filed on May 21, 1986.

BACKGROUND OF THE INVENTION

1. Field of the Invention

The present invention relates to a process for manufacturing an electrical contact pin having a fixing part to be fitted into a through hole of a circuit board without using any solder.

2. Description of the Prior Art

Electrical contact pins of this type are sometimes called "press fit contactors" and disclosed for example in U.S. Pat. Nos. 4,223,970 issued to Leo Walter on Sept. 23, 1980, and 4,464,009 to Hartmuth Thaler on Aug. 7, 1984, and Japanese Patent Kokai No. 58-123,678.

Walter Patent discloses a compliant backplane electrical connector having a pin with four edges at the corners of the generally rectangular, Z-shaped cross section of the pin. Such edges penetrate the plating of an opening upon insertion of the pin into the opening.

Thaler Patent discloses a solderless connector pin for electrical circuits. It has an elongated deformable region having an M-shaped or W-shaped cross section. Upon insertion of the pin into a bore, the deformable region deforms elastically and, in the case of a small diameter bore, partially plastically to provide a good electrical and mechanical connection between the pin and the plate.

Japanese Pat. No. 58-123,678 discloses, as shown in FIG. 6(D), a contact pin consisting of a fixing part 1 having an N-shaped cross section with a pair of triangular recesses 2 and 3 arranged in an alternating fashion on opposite sides. In order that corners 4 and 5 adjacent to these triangular recesses fully abut the conductive through hole of a circuit board, the opposite corners of the terminal are rounded to form chamfers 6 and 7. The fixing part 1 of contact pin 9 with such structure has a springy accordion-like property.

The following is one of the methods of manufacturing such contact pins by using a press machine. This process may be illustrated as follows:

(1) As FIG. 6(A) shows, upper and lower metal dies 20 and 30 have triangular projections 21 and 31 to form the triangular recesses 2 and 3 and rounded corners 22 and 32 to form chamfers 6 and 7, respectively, of a metallic work or fixing part 1.

(2) These dies are mounted on a press and pressed against the metallic work 1 in the vertical direction. As FIG. 6(B) shows, indefinite burrs or fins 2' and 3' are formed because of the presence of triangular projections 21 and 31 and rounded corners 22 and 32.

(3) As FIG. 6(C) shows, these undesired burrs or fins 2' and 3' are cut off by a pair of press cutters 22 and 33.

(4) As FIG. 6(D) shows, finally, a fixing part having an N-shaped cross section is completed.

Electrical contact pins having such a springy accordion-like fixing part as described above have been developed so as to fit into through holes in a certain range of diameters of a circuit board. However, they still have the following disadvantages:

(1) Where the diameter of a through hole is relatively large, although the corners 4 and 5 adjacent to the triangular recesses can abut the conductive wall of a through hole making electrical connection, the other corners or chamfers 6 and 7 cannot abut the conductive wall, thus as a whole making poor connection and increasing contact resistance especially after a vibration or shock has been applied for a long period.

(2) Where the diameter of a through hole is relatively small, the non-springy chamfers 6 and 7 strongly abut the conductive wall (solder layer) and badly damage it, thus increasing contact resistance or making conduction impossible because of complete separation of the conductive wall from the through hole.

(3) The indefinite burrs or fins 2' and 3' formed in the pressing step are so small that it is a difficult operation to cut them off. In addition, the resulting cuts become broken surfaces **6*b* and 7*b* as shown in FIG. 6(D) making the corners 4 and 5** imperfect or too short to cut into the conductive wall of a through hole or reducing the accordion-like spring force of the corners.

SUMMARY OF THE INVENTION

Accordingly, it is an object of the invention to provide a process for manufacturing an electrical contact pin having a fixing part to always be fitted into a through hole regardless of a considerable amount of its variations, thus always making good electrical and mechanical connection.

In accordance with the invention there is provided a process for manufacturing an electrical contact pin having a fixing part to be fitted into a through hole of a circuit board for fixing without using any solder, said fixing part having a substantially rectangular cross section, at least a pair of alternating recesses provided on a pair of opposite side of said rectangular section, a pair of corners closer to said recesses extending beyond said sides to form a pair of projected corners, characterized by the step of pressing a metal work having a substantially rectangular cross section to form said fixing part in a pair of metal dies, a pair of projections provided on the bottoms of said dies to form said recesses, a pair of opposite sides of said dies arranged so that there may be small spaces between said pair of sides and the opposite sides of said work before pressed, and a part of said bottom of each die made deeper than the rest of said bottom so as to form said projected corner when said work is squeezed.

Other and further objects, features and advantages of the invention will appear more fully from the following description in connection with the accompanying drawings.

DESCRIPTION OF THE PREFERRED EMBODIMENTS

Figure 1:
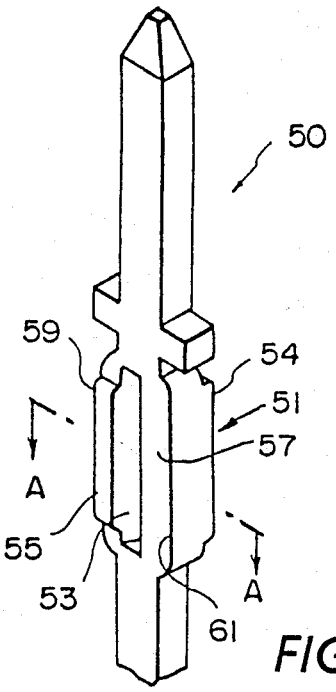
FIG. 1 is a perspective view of an electrical contact pin embodying the present invention.
Figure 2:
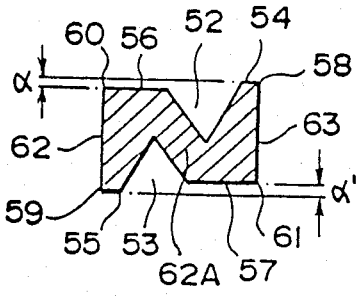
FIG. 2 is a sectional view taken along the line A—A of FIG. 1.

Embodiments of the present invention will be described below with reference to the accompanying drawings, wherein FIG. 1 is a perspective view of an electrical contact pin embodying the present invention, FIG. 2 is a sectional view taken along the line A—A of FIG. 1, FIG. 3 is a sectional view of the contact pin fitted into a through hole, and FIG. 4 illustrates a manufacturing process by means of a press.

As FIGS. 1 and 2 show, an electrical contact pin 50 according to the invention has in its middle portion a fixing part 51 to be fitted into a through hole of a circuit board. This fixing part has a pair of triangular recesses 52 and 53 arranged in alternating form. A pair of projections 54 and 55 extending by $\alpha$ and $\alpha'$ from opposite surfaces 56 and 57 are formed at diagonally opposing corners adjacent to the triangular recesses 52 and 53. The outside corners of projections 54 and 55 and the other diagonally opposing corners have sharp corners or edges 58, 59, 60 and 61 respectively. These corners are made not necessarily at right angles but must be sufficiently sharp to cut into the conductive wall of a through hole. They may be rounded corners or chamfers. There is a slanted intermediate portion 62A between the triangular recesses 52 and 53.

Figure 3A:
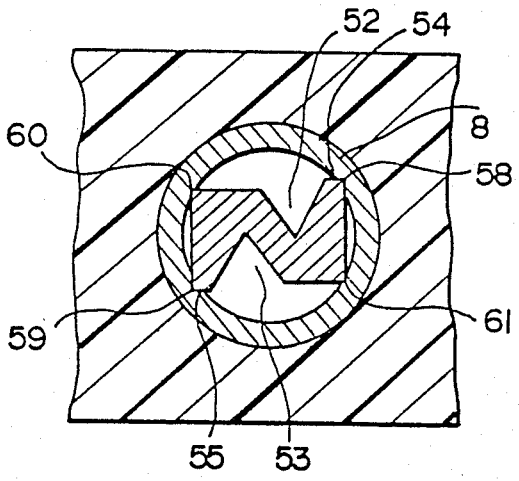
FIGS. 3A and 3B are sectional views of the electrical contact pin of FIG. 1 that is fitted into a through hole.
Figure 3B:
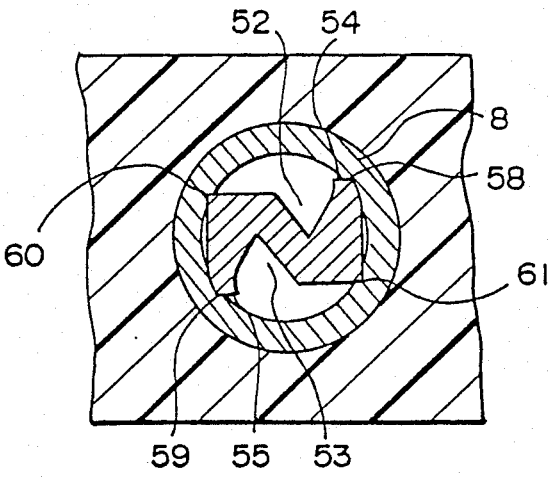

The electrical contact pin 50 of such a structure is capable of fitting into through holes of somewhat different diameters of a circuit board. FIGS. 3(A) and 3(B) show in section the contact pins 50 fitted into through holes 8 of relatively large and small inside diameters, respectively.

In FIG. 3(A), the outer corners 58 and 59 of projections 54 and 55 cut into the conductive wall of a through hole 8 and the other diagonal corners 60 and 61 also cut into the conductive wall although the amount of their cut is less than that of the outer corners 58 and 59.

In FIG. 3(B), as the contact pin is fitted into a through hole of a small diameter, the springy projections 54 and 55 are bent inward while the projection corners 58 and 59 cut into the conductive wall. The other corners 60 and 61 cut into the conductive wall deeper than in the case of a larger hole. Thus, the contact pin according to the invention can always cut into the conductive wall at four points of a through hole regardless of its diameter variations, eliminating the occurrence of poor contact when a vibration or shock is applied for a long period of time.

Figure 4A:
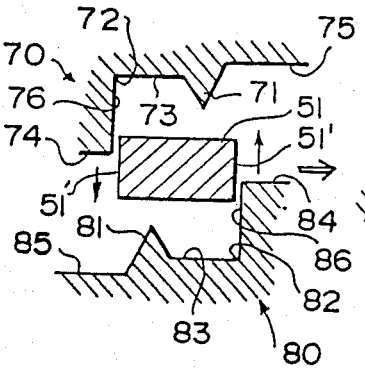
FIGS. 4A, 4B and 4C illustrate a process of pressing an electrical contact pin according to the invention.

FIG. 4 illustrates a process for manufacturing a contact pin 50 having such a fixing part 51 as described above. As FIG. 4(A) shows, a pin element having a fixing part 51 with a rectangular section, which has been stamped out of a sheet of metal, is placed between the upper and lower dies 70 and 80. The upper die 30 has a triangular projection 71 to form the trianglular recess 52 of fixing part 51, a bottom surface 73 to form the surface 56, a corner 72 to form the corner 60, a left-hand projection surface 74 to abut the left-hand bottom surface 85 of lower die 80 when both dies are pressed, and a right-hand bottom surface 75 that is made higher than the bottome surface 73. Similarly, the lower die 80 has a triangular projection 81, a bottom surface 83, and a corner 82 to form the triangular recess 53, surface 57, and corner 61, respectively, and a right-hand projection surface 84 to abut the right-hand bottom surface 75 of upper die 70 when both dies are pressed, and a left-hand bottom surface 85 that is made lower than the bottom surface 83.

Figure 4B:
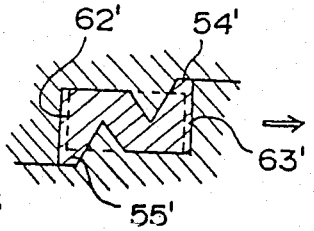

FIG. 4(B) shows, the upper and lower die 70 and 80 are pressed by a press machine to squeeze the metal work 51 to form a fixing part having an N-shaped cross section. There are spaces 54' and 55' between the mold cavity and the metal work before pressing as shown in dotted line. The triangular projections 71 and 81 of upper and lower dies 70 and 80 push metal from the recesses 52 and 53 into these spaces 54' and 55' to form projections 54 and 55 with corners 58 and 59. There are narrow spaces 62' and 63' between the side walls 76 and 86 of upper and lower dies 70 and 80 and the opposite sides 51' of metal work 51 before pressed. The opposite sides 62 and 63 of N-shaped fixing part 51 can expand upon pressing into these spaces, making the pressing operation easier than prior art.

Figure 4C:
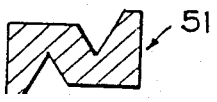

FIG. 4(C) shows the finished fixing part 51 in section that is the same as in FIG. 2.

Figure 5A:
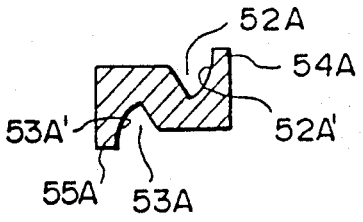
FIGS. 5(A), (B), and (C) are sectional views of other embodiments of the present invention.
Figure 5B:
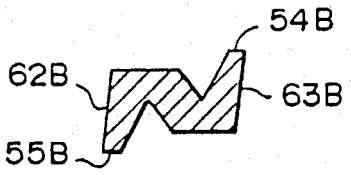
Figure 5C:
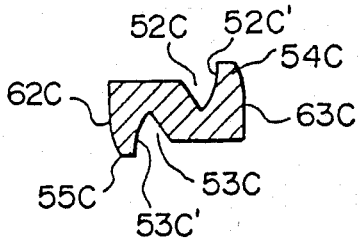
Figure 6A:
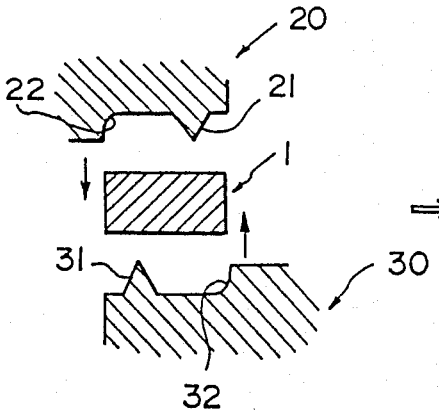
FIG. 6 A PRIOR ART
FIGS. 6A, 6B, 6C and 6D illustrate a process of forming an electrical cotact pin according to the prior art.
Figure 6B:
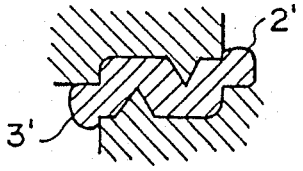
FIG. 6 B PRIOR ART
Figure 6C:
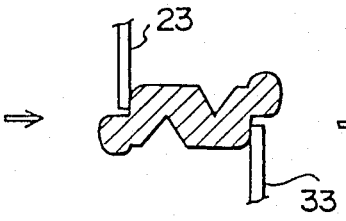
FIG. 6 C PRIOR ART
Figure 6D:
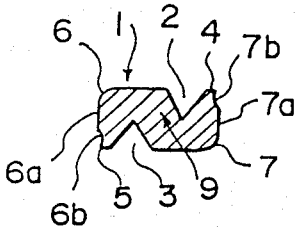
FIG. 6 D PRIOR ART

FIGS. 5(A), 5(B), and 5(C) illustrate other embodiments of the present invention. In FIG. 5(A), the outer sides 52A' and 53A' of recesses 52A and 53A are curved or concave to give more springy quality to the projections 54A and 55A, respectively.

In FIG. 5(B), the left side 62B and right side 63B of projections 55B and 54B are inclined with the tip outward so that the pressing operation may be easier than prior art.

In FIG. 5(C), both sides 52C' and 53C' of recesses 52C and 53C and the tips of left and right sides 62C and 63C are curved so that the contact pin may fit into a smaller through hole at a larger contact area with the conductive layer of the through hole.

According to the invention there are provided the following advantages:

(1) Where the inside diameter of a through hole is relatively large, individual corners of a contact pin cut into the conductive wall of the through hole so firmly that there is little or no danger of causing poor contact or increased contact resistance even if it is subjected to a long period of vibrations or shocks.

(2) When the inside diameter of a through hole is relatively small, the projections of the fixing part are elastically curved inward while cutting into the conductive wall and the other corners firmly cut into the conductive wall so that there is little or no possibility of damaging the conductive wall or increasing the contact resistance or separating the conductive wall from the through hole.

(3) There are neither burrs nor fins of excess metal caused by the pressing operation so that the N-shaped fixing part, which is easy to cut into the conductive wall of a through hole, may be formed by only a single pressing operation, thus providing an inexpensive but reliable contact pin.

Although the preferred embodiments of the present invention have been described above, other embodiments and modifications which would be apparent to one having ordinary skill in the art are intended to be covered by the spirit and scope of the appended claims.

What is claimed is:

1. A process for manufacturing an electrical contact pin having a fixing part to be fitted into a through hole of a circuit board for fixing without using any solder, said fixing part having a substantially rectangular cross section, a pair of alternating substantially triangular recesses provided on a pair of opposite sides of said rectangular section, a pair of sharp corners adjacent to said triangular recesses extending beyond said sides to form a pair of resilient projected sharp corners, characterized by the step of pressing a metal work having a substantially rectangular cross section to form said fixing part in a pair of metal dies, a pair of alternating substantially triangular projections provided on the bottoms of said dies to form said substantially triangular recesses, a pair of opposite sides of said dies arranged so that there may be first small spaces between said pair of sides and the opposite sides of said work before pressed, and a part of said bottom of each die made deeper than the rest of said bottom to form a second small space between said part of said bottom and a top of said rectangular work, which communicates with said first space so as to form said resilient projected sharp corner when said work is squeezed between said metal dies.

2. A process for manufacturing an electrical contact pin having a fixing part to be fitted into a through hole of a circuit board for fixing without using any solder, said fixing part having a substantially rectangular cross section, a pair of alternating substantially triangular recesses provided on a pair of opposite sides of said rectangular section to form a substantially N-shaped cross-section, with four sharp corners, a pair of corners adjacent to said triangular recesses extending beyond said sides to form a pair of resilient projected corners, said process comprising the steps of:

stamping from a sheet of metal a contact pin element with a fixing part section having a substantially rectangular cross-section;

subjecting said rectangular fixing part section to a single pressing operation between a pair of upper and lower metal dies, each having a generally L-shaped cross-section consisting of a lateral base portion and a vertical leg portion;

an inside surface of said base portion consisting of a first die surface adjacent to said vertical leg portion and a second die surface adjacent to a free end of said lateral base portion and a substantially triangular projection between said first and second die surfaces;

the distance between said first die surfaces of said upper and lower dies is substantially equal to the height of said rectangular fixing part section;

the distance between said second die surface of said upper or lower die and said first die surface of said lower or uppper die is made greater than the distance between said first die surfaces so as to form a first die cavity portion for receiving said projected corner; and the distance between inside surfaces of said leg portions of said upper and lower dies is greater than the width of said rectangular fixing part section so as to form a second die cavity portion for receiving a substantial portion of material replaced by said triangular projection during said pressing operation.

* * * * *